US011353241B2

(12) United States Patent
Callahan et al.

(10) Patent No.: US 11,353,241 B2
(45) Date of Patent: Jun. 7, 2022

(54) DEVICES FOR OHMICALLY HEATING A FLUID

(71) Applicant: Heatworks Technologies, Inc., Sullivans Island, SC (US)

(72) Inventors: Jeremiah M. Callahan, Sullivan's Island, SC (US); Eric J. Doesburg, Charleston, SC (US); Gregory S. Lyon, Mamaroneck, NY (US); Michael J. Wieckowski, Charleston, SC (US)

(73) Assignee: Heatworks Technologies, Inc., Sullivan's Island, SC (US)

( * ) Notice: Subject to any disclaimer, the term of this patent is extended or adjusted under 35 U.S.C. 154(b) by 385 days.

(21) Appl. No.: 16/346,354

(22) PCT Filed: Nov. 6, 2017

(86) PCT No.: PCT/US2017/060192

§ 371 (c)(1),
(2) Date: Apr. 30, 2019

(87) PCT Pub. No.: WO2018/085773

PCT Pub. Date: May 11, 2018

(65) Prior Publication Data

US 2019/0271487 A1 Sep. 5, 2019

Related U.S. Application Data

(60) Provisional application No. 62/458,201, filed on Feb. 13, 2017, provisional application No. 62/418,493, filed on Nov. 7, 2016.

(51) Int. Cl.

| | |
|---|---|
| ***F24H 1/10*** | (2022.01) |
| ***H05B 3/60*** | (2006.01) |
| ***F24H 9/1818*** | (2022.01) |

(52) U.S. Cl.
CPC ..... *F24H 1/106* (2013.01); *F24H 9/1818* (2013.01); *H05B 3/60* (2013.01); *H05B 2203/021* (2013.01)

(58) Field of Classification Search
None
See application file for complete search history.

(56) References Cited

U.S. PATENT DOCUMENTS 1,476,080 A * 12/1923 Kaelin ..... F22B 1/30 392/325
1,553,491 A * 9/1925 Werner ..... F24H 1/202 392/322

(Continued)

FOREIGN PATENT DOCUMENTS

CA 1291785 C 11/1991
CN 1918439 A 2/2007

(Continued)

OTHER PUBLICATIONS

Extended European Search Report with Written Opinion for Application No. 20177797.6 dated Sep. 21, 2020, 9 pages.

(Continued)

*Primary Examiner* — Thor S Campbell
(74) *Attorney, Agent, or Firm* — Lerner, David, Littenberg, Krumholz & Mentlik, LLP

(57) ABSTRACT

An ohmic heater for heating a conductive fluid has a plurality of electrodes mounted to a structure with spaces between the electrodes. The electrodes (14) are selectively connect to poles (38, 40) of a power supply, so that some electrodes are connected to the poles and others remain isolated from the poles. Shunting switches are provided for connecting two or more of the isolated electrodes to one another. The shunting switches allow formation of a large number of different connection schemes having a variety of different electrical conduction paths through fluid in the (Continued)

spaces and a variety of resistances between the poles with relatively few electrodes and spaces.

18 Claims, 4 Drawing Sheets

(56) References Cited

U.S. PATENT DOCUMENTS

| | | | | |
|---|---|---|---|---|
| 1,902,842 | A * | 3/1933 | Eaton | F22B 1/30 392/326 |
| 1,950,511 | A * | 3/1934 | Noll | F22B 1/30 392/328 |
| 2,748,253 | A * | 5/1956 | Bremer | F24H 1/106 392/318 |
| 3,796,857 | A * | 3/1974 | Henley | F24H 1/106 392/315 |
| 3,867,610 | A * | 2/1975 | Quaintance | A23L 3/005 392/318 |
| 3,925,638 | A * | 12/1975 | Scatoloni | F24H 1/106 392/320 |
| 4,417,132 | A * | 11/1983 | Simpson | A23L 3/005 392/320 |
| 4,418,269 | A * | 11/1983 | Eaton-Williams | F24F 6/025 392/326 |
| 4,730,098 | A * | 3/1988 | Cave | H05B 3/60 392/314 |
| 4,953,536 | A * | 9/1990 | Israelsohn | H05B 3/0004 392/314 |
| 6,080,971 | A * | 6/2000 | Seitz | F24H 9/2028 219/483 |
| 6,522,834 | B1 * | 2/2003 | Herrick | H05B 3/60 222/251 |
| 6,640,048 | B2 | 10/2003 | Novotny et al. | |
| 6,849,178 | B2 * | 2/2005 | Hecking | C02F 1/48 204/286.1 |
| 7,050,706 | B2 | 5/2006 | Israelsohn et al. | |
| 7,190,886 | B2 | 3/2007 | Dubicki et al. | |
| 7,403,701 | B2 | 7/2008 | Choi et al. | |
| 7,742,689 | B2 * | 6/2010 | Harrison | A47J 27/21025 392/314 |
| 7,817,906 | B2 | 10/2010 | Callahan et al. | |
| 7,903,956 | B2 | 3/2011 | Colburn et al. | |
| 8,532,474 | B2 * | 9/2013 | Campbell | H05B 3/60 392/311 |
| 8,565,588 | B2 | 10/2013 | Bierbaumer et al. | |
| 8,649,670 | B2 | 2/2014 | Lu et al. | |
| 8,861,943 | B2 | 10/2014 | Bowers et al. | |
| 9,423,151 | B2 | 8/2016 | Kacar et al. | |
| 9,644,499 | B2 * | 5/2017 | Byrd | F01K 3/186 |
| 10,281,138 | B2 * | 5/2019 | Mahoney | F22B 1/30 |
| 10,365,013 | B1 * | 7/2019 | Wieckowski | F24H 1/106 |
| 2006/0291527 | A1 * | 12/2006 | Callahan | H05B 3/60 373/108 |
| 2007/0154193 | A1 | 7/2007 | Harrison et al. | |
| 2010/0296800 | A1 | 11/2010 | Min et al. | |
| 2010/0322605 | A1 | 12/2010 | van Aken et al. | |
| 2011/0272392 | A1 | 11/2011 | Dohring et al. | |
| 2016/0288620 | A1 | 10/2016 | Pierron et al. | |
| 2016/0291527 | A1 | 10/2016 | Hashimoto et al. | |

FOREIGN PATENT DOCUMENTS

| | | | |
|---|---|---|---|
| CN | 101970947 | A | 2/2011 |
| CN | 102171516 | A | 8/2011 |
| CN | 103477158 | A | 12/2013 |
| CN | 105191488 | A | 12/2015 |
| CN | 105899888 | A | 8/2016 |
| DE | 10000101 | A1 | 8/2001 |
| EP | 0349689 | A1 | 1/1990 |
| JP | S59128221 | A | 7/1984 |
| JP | 2000340338 | A | 12/2000 |
| JP | 2011511910 | A | 4/2011 |
| JP | 2011511919 | A | 4/2011 |
| WO | 2005066551 | A1 | 7/2005 |
| WO | 2006119440 | A2 | 11/2006 |
| WO | 2009100486 | A1 | 8/2009 |
| WO | 2011148404 | A1 | 12/2011 |
| WO | 2012092641 | A1 | 7/2012 |
| WO | 2018085773 | A1 | 5/2018 |

OTHER PUBLICATIONS

Chinese Search Report for Application No. 201780078688.7, dated Jan. 5, 2021, 3 pages.

Search Report by Registered Searching Organization for JP2019545718 dated Feb. 24, 2021; 10 pages.

International Search Report including the Written Opinion from Application No. PCT/US2019/031752 dated Apr. 17, 2020, 18 pages.

Partial International Search Report for Application No. PCT/US2019/031752 dated Feb. 5, 2020, 7 pages.

International Search Report and Written Opinion for PCT/US2017/060192 dated Feb. 26, 2018.

* cited by examiner

DEVICES FOR OHMICALLY HEATING A FLUID

CROSS-REFERENCE TO RELATED APPLICATIONS

The present application is a national phase entry under 35 U.S.C. § 371 of International Application No. PCT/US2017/060192 filed Nov. 6, 2017, published in English, which claims the benefit of the filing date of U.S. Provisional Patent Application No. 62/458,201 filed on Feb. 13, 2017 and claims the benefit of U.S. Provisional Application No. 62/418,493 filed on Nov. 7, 2016, both of which are hereby incorporated by reference herein.

BACKGROUND OF THE INVENTION

The present disclosure relates to ohmic fluid heating devices, and methods of heating a fluid. An ohmic fluid heater can be used to heat an electrically conductive fluid as, for example, potable water. Such a heater typically includes plural electrodes spaced apart from one another. The electrodes are contacted with the fluid to be heated so that the fluid fills the spaces between neighboring electrodes. Two or more of the electrodes are connected to a power supply so that different electrical potentials are applied to different ones of the electrodes. For example, where an ohmic heater is operated using normal AC utility power such as that obtainable from a household electric plug, at least one of the electrodes is connected to one pole carrying an alternating potential, whereas at least one other electrode is connected to the opposite pole carrying a neutral or ground pole. Electricity passes between the electrodes through the fluid at least one space between the electrodes, and electrical energy is converted to heat by the electrical resistance of the fluid.

It is desirable to control the rate at which electrical energy is converted to heat, (the "heating rate"), in such a heater to achieve the desired temperature of the heated fluid. It has been proposed to vary the heating rate by mechanically moving electrodes closer relative to one another, thereby varying the electrical resistance between the electrodes. Such arrangements, however, require complex mechanical elements including moving parts exposed to the fluid. Moreover, it is difficult to make such mechanisms respond quickly to deal with rapidly changing conditions. For example, if an ohmic heater is used in an "instantaneous heating" arrangement to heat water supplied to a plumbing fixture such as a shower head, the water continually passes through the heater directly to the fixture while the fixture is in use. If the user suddenly increases the flow rate of the water, as by opening a valve on the fixture, the heater should react rapidly to increase the heating rate so as to maintain the water supplied to the fixture at a substantially constant temperature.

It has also been proposed to provide an ohmic heater with a substantial number of electrodes and with power switches to selectively connect different ones of the electrodes to the poles of the power supply. For example, an array of electrodes may be disposed in a linear arrangement with spaces between the electrodes. The array includes two electrodes at the extremes of the array and numerous intermediate electrodes between the two extreme electrodes. To provide a minimum heating rate, the extreme electrodes are connected to opposite poles of the power supply, and the intermediate electrodes are isolated from the poles. The electric current passes from one extreme electrode through the fluid in a first space to the nearest one of the intermediate electrodes, then through fluid in the next space to the next isolated electrode and so on until it reaches the last intermediate electrode, and flows from the last intermediate electrode to the other extreme electrode. Thus, the fluid within all of the spaces is electrically connected in series between the two extreme electrodes. This connection scheme provides high electrical resistance between the poles of the power supply and a low heating rate.

For a maximum heating rate, all of the electrodes are connected to the poles so that each electrode is connected to the opposite pole from its next nearest neighbor. Stated another way, alternate ones of the electrodes are connected to the hot pole and to the neutral pole. In this condition, the fluid in each space is directly connected between the poles of the power supply, in parallel with the fluid in every other space. The connection scheme provides minimum resistance between the poles. Intermediate heating rates may be achieved by connecting various combinations of electrodes to the poles of the power supply. For example, in one such connection scheme, two of the intermediate electrodes are connected to opposite poles of the power supply, and the remaining electrodes are electrically isolated from the poles of the power supply. The connected intermediate electrodes are separated from one another by a few other intermediate electrodes and a few spaces, so that fluid in only a few spaces is connected in series between the poles. This connection scheme provides a resistance between the poles that is higher than the resistance in the maximum heating rate scheme, but lower resistance than the resistance in the minimum heating rate scheme. With fluid having a given conductivity, different connection schemes will provide different resistances between the poles, and thus different heating rates. Because the resistance with a given connection scheme decreases as the conductivity increases, a parameter referred to herein as "specific resistance" is used in this disclosure to characterize a circuit or a part of a circuit having elements electrically connected by a fluid. The specific resistance is the ratio between the electrical resistance of the circuit or part of a circuit and the resistivity of the fluid in the circuit.

Typically, the switches are electrically controllable switches such as semiconductor switching elements as, for example, thyristors. Ohmic heaters of this type can switch rapidly between connection schemes and thus switch rapidly between heating rates. Such heaters do not require any moving parts in contact with the fluid to control the heating rate. However, ohmic heaters of this type can only select from among the set of the specific resistances fixed by the physical configuration of the electrodes, and thus the heating rate, in steps. Under certain conditions, the available heating rates may not match the heating rate which produces the desired fluid temperature. This drawback can be more significant for those heaters which are used in a range of different conditions such as fluids of widely differing conductivities, different flow rates of fluid flowing through the heater at different rates; different fluid inlet temperatures and different fluid outlet temperatures. For example, if the heater provides a set of different specific resistances between a highest specific resistance usable to provide a low heating rate with a fluid of relatively high conductivity and a lowest specific resistance usable to provide a high heating rate with a fluid of low conductivity, only a small subset of the available specific resistances will be within a range useful to regulate the temperature of a particular fluid. Adding more electrodes increases the cost of and size of the heater. Moreover, additional electrodes can produce redundant connection schemes such that different ones of the connection schemes provide the same specific resistance between the poles of the power supply, in which case the additional electrodes offer little benefit.

One solution to this problem is disclosed in U.S. Pat. Nos. 7,817,906 and 8,861,943, the disclosures of which are hereby incorporated by reference herein. As disclosed in these patents, providing electrodes in an arrangement with non-uniform specific resistances between pairs of neighboring electrodes as, for example, providing electrodes at non-uniform spacings can provide an ohmic heater suitable for operation under a wide range of conditions. Desirably, the specific resistances between pairs of neighboring electrodes are selected so that, for a fluid of a given conductivity, the power levels available using different connection schemes include a series of non-redundant specific resistances extending over a very wide range. For example, such a heater may provide 60 or more specific resistances in a substantially logarithmic series, i.e., a series of specific resistances such that a ratio between each specific resistance and the next lower specific resistance is substantially constant. Such an arrangement provides a useful solution which has been employed commercially in demanding applications as, for example, an instantaneous heater for domestic hot water. However, this approach still requires a relatively large number of electrodes. For example, certain embodiments of the heater may use over 20 electrodes and to attain this level of performance It would be desirable to provide an ohmic heater which can deliver a large number of different power levels using fewer electrodes.

BRIEF SUMMARY OF THE INVENTION

One aspect of the present invention provides a heater for heating an electrically conductive fluid. A heater according to this aspect of the invention desirably includes a structure and a plurality of electrodes mounted to the structure, the electrodes being mounted to the structure with spaces between neighboring ones of the electrodes. The structure is the structure being adapted to maintain the electrodes in contact with the fluid with fluid in the spaces, so that fluid in the spaces contacts the electrodes and electrically connects neighboring electrodes to one another. The heater desirably includes an electrical power supply having at least two poles, the power supply connection being operable to supply different electrical potentials to different ones of the poles. The structure desirably also includes power switches electrically connected between at least some of the electrodes and the poles, the power switches being operable to selectively connect the electrodes to the poles and to selectively disconnect electrodes from the poles, the power switches being operable to connect and disconnect electrodes so that the electrodes include at least first and second connected electrodes connected to different poles of the power supply and first and second isolated electrodes disconnected from the poles.

Preferably, the heater further includes shunting switches electrically connected to at least some of the electrodes, the shunting switches being operable to selectively form a shunt connection between the first and second isolated electrodes. Desirably, the power switches and shunting switches are operable to connect the electrodes in a plurality of connection schemes so that different ones of the electrodes constitute the connected electrodes and the isolated electrodes in different ones of the connection schemes. As further discussed below, the ability to form shunt connections between isolated electrodes provides numerous unique connection schemes in addition to the connection schemes which can be formed using the power switches, without shunt connections. The additional connection schemes typically have specific resistances different from those achievable without shunting connections. Thus, heaters according to certain embodiments of the present invention can provide a satisfactory sequence of specific resistances with fewer electrodes than are required to provide a similar sequence in a comparable heater without shunting capability.

A further aspect of the present invention provides methods of heating a conductive fluid. A method according to this aspect of the invention contacting the fluid with a plurality of electrodes having spaces between neighboring ones of the electrodes so that the fluid in the spaces contacts the electrodes and electrically connects neighboring electrodes to one another. The method desirably includes selectively connecting and disconnecting the electrodes with poles of a power supply so that the electrodes include at least first and second connected electrodes connected to different poles of the power supply and first and second isolated electrodes disconnected from the poles. Preferably, the method includes the further step of electrically connecting the first and second isolated electrodes to one another without connecting the first and second isolated electrodes to the poles of the power supply.

Other aspects and features of the invention will be apparent from the detailed description set forth below.

DETAILED DESCRIPTION

Figure 1:
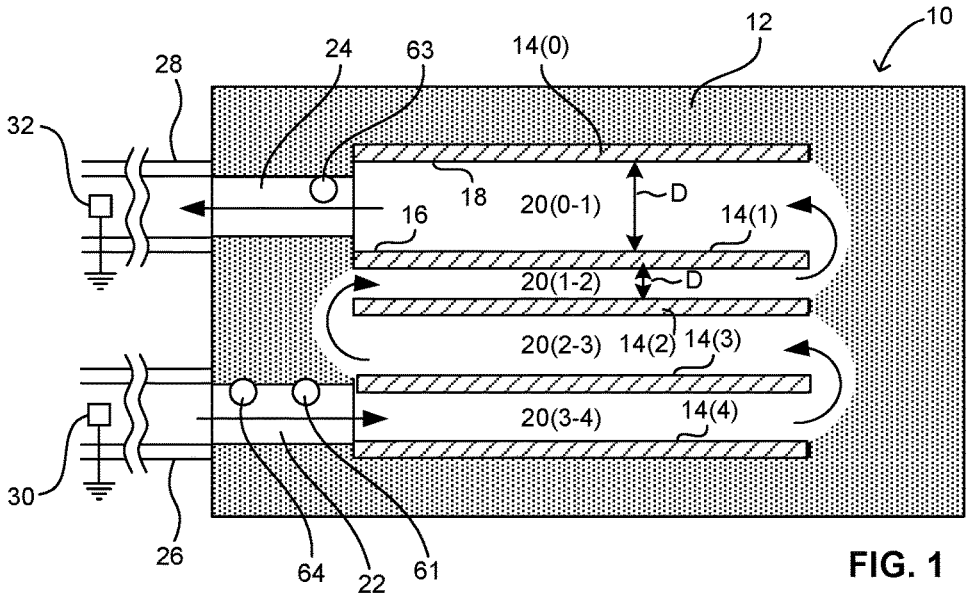
FIG. 1 is a diagrammatic sectional view depicting a heater according to one embodiment of the invention.

A heater in accordance with one embodiment of the invention (FIG. 1) includes a structure 12 in the form of a hollow housing 14. Five electrodes 14 are mounted to the housing. As shown in FIG. 2, each electrode is generally a flat rectangular plate having major surfaces 16 and 18 facing in opposite directions with edge surfaces extending between these major surfaces. The electrodes 14 are mounted in housing 12 so that spaces 20 are defined between neighboring ones of the electrodes. As used in this disclosure with reference to electrodes, the expression "neighboring" means that a continuous space uninterrupted by any other electrode extends between the two neighboring electrodes. The major surfaces of electrodes 14 face one another so that the electrodes are disposed in a stack with the major surface 18 of one electrode facing towards the opposite major surface 16 of the neighboring electrode. The major surfaces of the electrodes in this arrangement are parallel to one another so that the distance between the electrode surfaces bounding each space is uniform over the entire extent of the space. However, in this arrangement the electrodes are non-uniformly spaced from one another. Thus the distance between each pair of neighboring electrodes is different from the distances between other pairs of neighboring electrodes.

Figure 2:
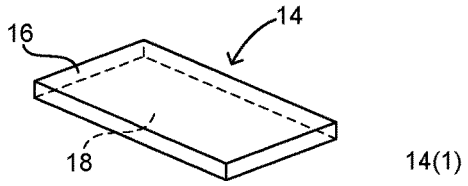
FIG. 2 is a diagrammatic perspective view of an electrode used in the heater of FIG. 1.

In FIG. 1, each electrode 14 has an ordinal number shown in parenthesis next to the reference numeral 14. The ordinal number denotes the position of the particular electrode in the stack from top to bottom as seen in FIG. 1. Thus, electrode 14(0) is nearest the top of the drawing; electrode 14(1) is next, followed by electrodes 14(2), 14(3), and 14(4) in that order, with electrode 14(4) being nearest the bottom of the stack. Each space 20 has an ordinal designation corresponding to the ordinal designation of the two electrodes bounding that particular space. For example, space 20(0-1) is bounded by electrodes 14(0) and 14(1); space 20(1-2) is bounded by electrode 14(1) and electrode 14(2), and so on.

The electrodes may be formed from any electrically conductive material compatible with the fluid to be heated. For example, where the fluid is water, the electrodes may be formed from materials such as stainless steel, platinized titanium or graphite. The structure forming housing 12 also may include any material compatible with the fluid but should include a dielectric material or materials arranged so that the housing does not form an electrically conductive path between any of the electrodes.

The housing 12 defines an inlet 22 and an outlet 24 communicating with the spaces. The electrodes 14 are arranged within housing 12 so that, in cooperation with the housing, they form a continuous flow path between the inlet 22 and the outlet 24. The electrodes and housing are arranged so that fluid passing from the inlet to the outlet will pass through all of the spaces 20 in series. In this instance, the fluid passes through spaces 20(3-4); 20(2-3); 20(1-2); and 20(0-1) in that order before reaching the outlet 24. Thus, fluid may be directed through the heater and inlet conduit 26 and outlet conduit 28. Ground electrodes 30 and 32 optionally may be provided within the inlet and outlet conduits. These ground electrodes desirably are remote from electrodes 14.

Figure 3:
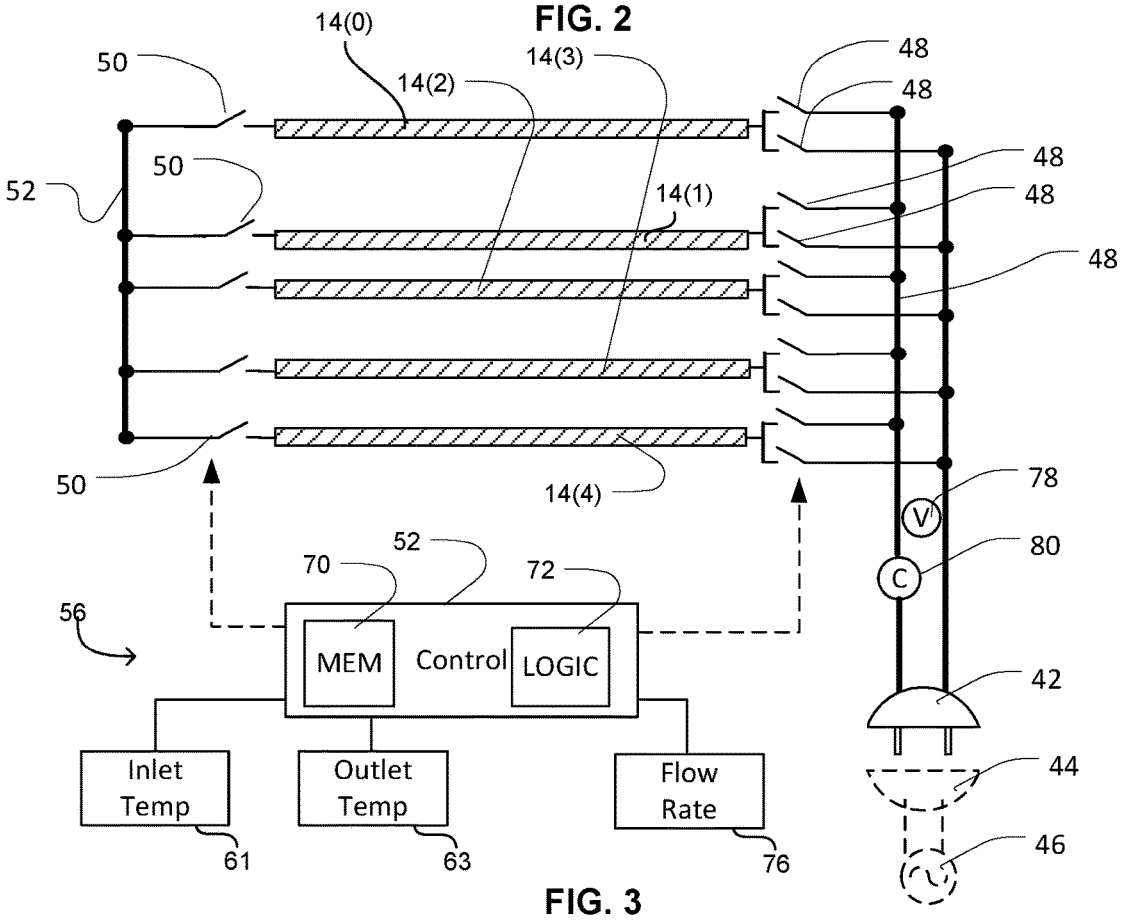
FIG. 3 is a partially block diagrammatic electrical schematic of the heater shown in FIGS. 1 and 2.

The heater as discussed above with respect to FIGS. 1 and 2 also includes an electrical circuit (FIG. 3). The circuit includes a power supply 36 incorporating two poles in the form of conductors 38 and 40. These conductors are connected to a plug 42 adapted for connection to a source of electrical power such as a utility power socket 44 which is connected in the normal fashion to utility power mains ultimately connected to an electrical generator 46. The conductors are arranged so that in operation, different electrical potentials are applied to poles 38 and 40. For example, conductor 40 may be a neutral conductor which receives a neutral voltage, typically close to ground voltage, whereas conductor 38 may be a "hot" conductor which will receive an alternating voltage supplied by an AC power source.

Power switches 48 are connected between the electrodes 48 and power source 36. Power switches 48 are arranged so that each electrode may be connected to either one of poles 38 and 40 or may be left isolated from the poles. As used in this disclosure, the term "switch" includes mechanical switches which may be manually actuated or actuated by devices such as relays or the like and also includes solid state devices that can be actuated to switch between a conducting condition with very high impedance and an "on" condition with very low impedance. Examples of solid state switches elements include triacs, MOSFETs, thyristors, and IGBTs. In the particular arrangement depicted, two individual single pole single throw switches are associated with each electrode, each being operable to connect the associated electrode with a different one of the poles, and the electrode is isolated from both poles when both switches are open. However, this arrangement can be replaced by any other electrically equivalent switching arrangement.

As further discussed below, electrodes 14 which are isolated from the power source 36 by operation of switches 48 may be electrically connected to one or more other electrodes by the fluid in the spaces 20, and the other electrodes may be connected to the poles. Such indirect connections are ignored in determining whether or not an electrode connected to the poles. Stated another way, as used in this disclosure, a statement that an electrode is connected to a pole of the power supply should be understood as meaning that the electrode is directly connected to the power supply through the power supply switches and associated electrical conductors.

The circuit further includes shunting switches 50. One shunting switch is connected to each of the electrodes. The shunting switches are also connected to a first shunting bus 52 so that any two or more of the electrodes 14 may connected to one another by closing the shunting switches 50 connected those electrodes to form a shunt connection including the closed switches 50 and the shunting bus 52.

In operation, a conductive fluid as, for example, a conductive liquid such as potable water is passed through the housing from the inlet to the outlet so that the fluid is present within spaces 20 (FIG. 1) between electrodes 14 and so that the electrodes contact the fluid. Thus, the fluid within each space forms an electrically conductive path between the neighboring electrodes bounding the space. Because the distances D (FIG. 1) between pairs of neighboring electrodes differ from one another, the electrical resistances of the fluid in the spaces will also differ. For example, where the spaces are all filled with liquid of the same conductivity, the path between electrodes 14(0) and 14(1) through space 20(0-1) is longer than the path between electrodes 14(1) and 14(2) through space 20(1-2). Thus, the path through space 20(0-1) will have higher resistance and lower conductivity than the path through space 20(1-2). Stated another way, the various spaces have different specific resistances.

In operation, a fluid is passed through the heater and electrical power is supplied to poles 38 and 40. At least two electrodes are connected to poles 38 and 40 of the power supply 36 by closing one or more of its power switches 48. At least one of the connected electrodes is connected to one of the poles and at least one of the connected electrodes is connected to the opposite one of the poles so that electrical current flows through fluid in at least some of the spaces which are disposed between the oppositely connected electrodes. The total current passing through the fluid in the various spaces and hence the power dissipated in the fluid and converted to heat by the resistance of the fluid, will depend upon the resistance of the current path between the opposite poles of the power supply through the oppositely connected electrodes and through the various spaces in the current path between these electrodes. Some connection schemes may be defined using only the power switches 48 and leaving all of the shunting switches 50 open. For example, where electrode 14(0) is connected to hot pole 38 or vice versa, and all of the other electrodes 14(1), 14(2), and 14(3) are disconnected from the poles, the conductive path extends through the fluid in all of spaces 20, with the resistances of the fluid in all of the paths connected in series with one another so that relatively little current flows between the poles. This connection provides the maximum specific resistance and the minimum non-zero heating rate. This connection scheme has a high specific resistance between the poles of the power supply. In another connection scheme, electrodes 14(0), 14(2) and 14(4) may all be connected to the neutral pole 40, whereas electrodes 14(1) and 14(3) may be connected to the hot pole 38. In this connection scheme, the conduction path extends through the electrical resistances of every one of the spaces 20 in parallel with one another so that the specific resistance between the poles is low, and the heating rate is as high as possible. Some connection schemes having specific resistances, and hence heating rates, between these extremes can be provided using only the power switches 48, again leaving shunting switches 50 open. For example, electrode 14(0) may be connected to the hot pole 38 of the power supply, whereas electrode 14(1) is connected to the neutral pole 40. The remaining electrodes are either isolated from the power supply by leaving the associated switches 48 open, or connected to the neutral pole so that they are at the same potential as electrode 14(1). In this connection scheme, the conduction path between the poles extends only through space 20(0-1) However, this connection and disconnection of the electrodes to the power supply while leaving the shunting switches 50 open can produce only a limited number of different interconnection schemes having different specific resistances and different heating rates.

Figure 4:
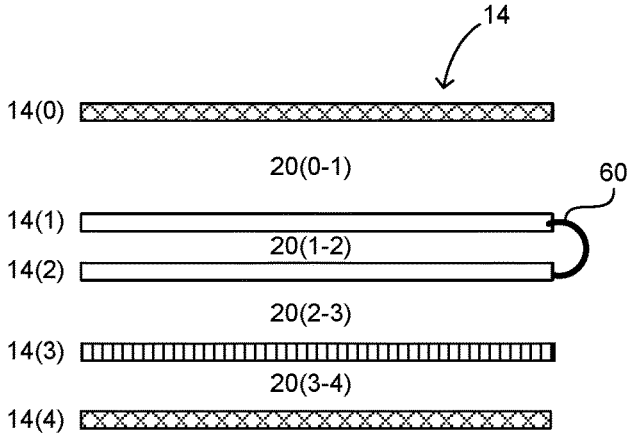
FIG. 4 is a diagrammatic view showing one connection scheme attainable with the heater of FIGS. 1-3.
Figure 5:
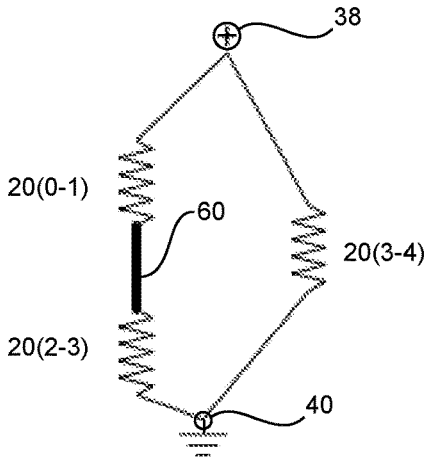
FIG. 5 is an electrical schematic of the connection scheme as shown in FIG. 4.
Figure 6:
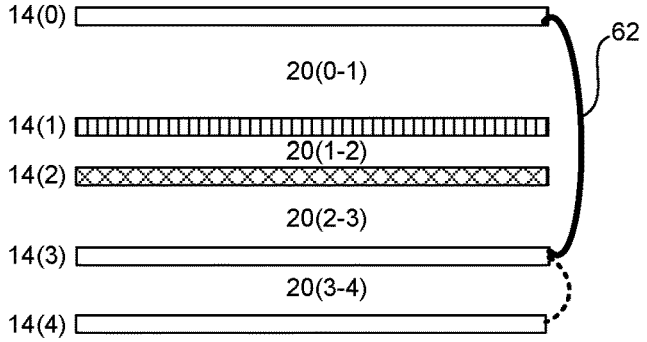
FIG. 6 is a view similar to FIG. 4 but depicting another connection scheme attainable with the heater of FIGS. 1-3.
Figure 8:
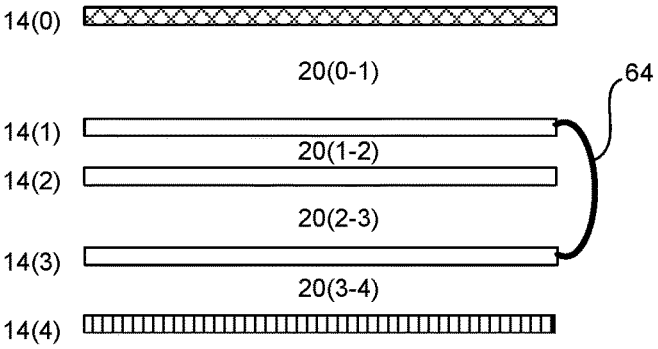
FIG. 8 is another view similar to FIGS. 4 and 6 but depicting yet another connection scheme attainable with the heater of FIGS. 1-3.
Figure 10:
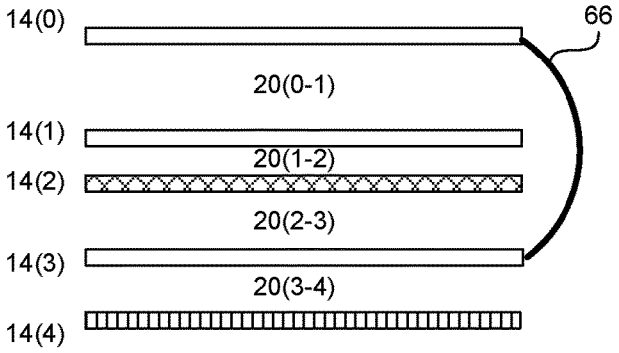
FIG. 10 is yet another view similar to FIGS. 4, 6, and 8, but depicting a still further connection scheme attainable with the heater of FIGS. 1-3.

Additional connection schemes can be using the shunting switches 50 in conjunction with the power switches 48. By closing two or more of the shunting switches 50, a shunt connection may be established between any two or more of the electrodes. This shunt connection is independent of the power supply, so that electrodes isolated from the power supply remain isolated when connected to one another. For example, the power switches 48 may be actuated to connect electrodes 14(0) and 14(4) to the hot pole 38 of the power supply and connect electrode 14(3) to the neutral or ground pole 40 of the power supply leaving electrodes 14(1) and 14(2) isolated from the power supply and the shunting switches 50 associated with electrodes 14(1) and 14(2) are actuated to connect the isolated electrodes 14(1) and 14(2) through a shunt connection including these shunting switches and a portion of the shunting bus 52. This connection scheme is schematically depicted in FIGS. 4 and 5, with the shunt connection being indicated at 60 in FIG. 4. In FIG. 4 as well as in FIGS. 6, 8, and 10 discussed below, connection of an electrode to the hot pole 38 is indicated by the cross-hatch shading, whereas connection to the neutral pole is indicated by the vertical line shading and isolation from the power supply is indicated by no shading. In this connection scheme, a conductive path extends from hot pole 38 and electrode 14(0) through space 20(0-1) to electrode 14(1), through the shunt connection 60 to electrode 14(2) and through space 20(2-3) to electrode 14(3). Stated another way, this conductive path includes a first connected electrode, a first space, and a first isolated electrode; the shunt connection 60, a second isolated electrode and a second space connecting the second isolated electrode to the second connected electrode. This path thus includes the electrical resistances of the fluid in spaces 20(0-1) and 20(2-3) connected in series with one another by shunt connection 60. This path is connected between the hot pole 38 and the neutral pole 40 of the power supply. The fluid in space 20(1-2) does not form an effective part of the conductive path because the electrical resistance of shunt connection 60 is substantially lower than the resistance of the fluid in space 20(1-2). In the same connection scheme, a further conductive path extends from hot pole 38 through electrode 14(4) through the fluid in space 20(3-4) to electrode 14(3). This further conductive path is in parallel with the first mentioned conductive path including spaces 20(0-1) and 20(2-3). Thus, the electrical resistance of the fluid in space 20(3-4) is connected in parallel with the resistances of the fluid in spaces 20(0-1) and 20(2-3) forming a composite series parallel path between the poles. This connection scheme will have a specific resistance different from any specific resistance obtainable without a shunt connection.

Figure 7:
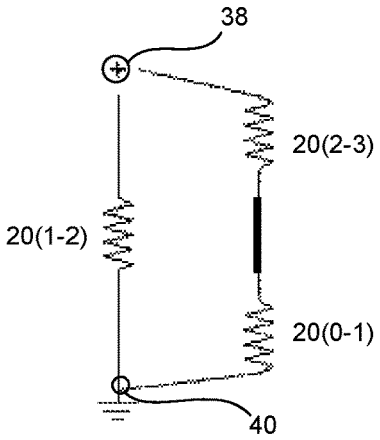
FIG. 7 is an electrical schematic of the connection scheme shown in FIG. 6.

In another example (FIGS. 6 and 7) electrodes 14(1) and 14(2) are connected to the opposite poles of the power supply, whereas electrodes 14(0) and 14(3) are disconnected from the power supply and connected to one another by a shunt connection 62 established through the associated shunting switches 50 (FIG. 1) and the shunting bus 52. In this connection scheme, a conduction path extends from the hot pole 38 through connected electrode 14(2), through space 20 (2-3) to isolated electrode 14(3); from isolated electrode 14(3) through the shunt connection 62 to isolated electrodes 14(0) and through space 20(0-1) to connected electrode 14(1) and the neutral pole 40 of the power supply. This conduction path is in parallel with another conductive path from the hot pole and electrode through space 20(1-2) as indicated schematically in FIG. 7. Here again, the resistances of the fluid in two of the paths are connected in series with one another, and this series path is connected in parallel with a path through another pair of electrodes. Electrode 4 may be left entirely unconnected or may be connected to the shunt bus. In either case, electrode 14(4) will have substantially the same electrical potential as electrode 14(3) so that no current flows through space 20(3-4). This connection scheme provides a different electrical resistance between the poles of the power supply and hence a different power dissipation from the connection shown in FIG. 5.

Figure 9:
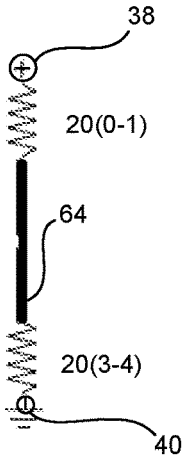
FIG. 9 is an electrical schematic of the connection scheme shown in FIG. 8.

In a further example (FIGS. 8 and 9), electrodes 14(1), 14(2), and 14(3) are all connected to the shunting bus to form a shunt connection 64 between all three of these electrodes, whereas electrode 14(0) is connected to the hot pole of the power supply and electrode 14(4) is connected to the neutral pole 40. The conductive path includes the fluid in spaces 20(0-1) and 20(3-4) in series with one another and the shunt connection. The fluid in spaces 20(1-2) and 20(1-3) does not form part of the conduction path as it is electrically bypassed by the shunt connection 64. In a variant of this connection scheme, the electrode 14(2) may be disconnected from the shunt bus. Because electrodes 14(1) and 14(3) are maintained at the same potential by the shunt connection, this will not change the conductive path.

In yet another example (FIGS. 10 and 11), a shunt connection 66 is established between electrode 14(0) and electrode 14(3). Electrode 14(2) is connected to the hot pole 38 whereas electrode 14(4) is connected to the neutral pole.

Figure 11:
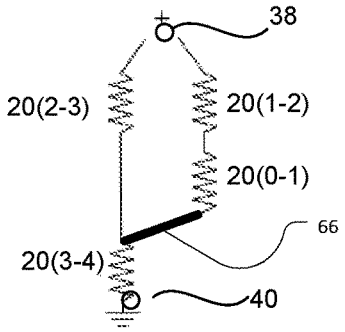
FIG. 11 is an electrical schematic of the connection scheme shown in FIG. 10.

In this arrangement, a conductive path extends from electrode 14(2) to electrode 14(1) through a first space 20(1-2) and through a second space 20(0-1); from electrode 14(0) through the shunt connection 66 to electrode 14(3) and from electrode 14(3) through the fluid in space 20(3-4) to electrode 4 and the neutral pole 40 of the power supply. A further conductive path extends from hot pole 38 and the connected electrode 14(2) through the fluid in space 20(2-3) to electrode 3 and from electrode 3 through the fluid in space 20(3-4) to electrode 14(4) and the neutral pole 40. Thus, as shown in FIG. 11, the fluid in spaces 20(1-2) and 20(0-1) electrically connected in series with one another and this series connection is in parallel with the fluid in space 20(2-3). This series-parallel connection of the fluid spaces is in series with the fluid in space 20(3-4).

Using the power supply switches and shunting switches and numerous other combinations can be made so as to provide numerous unique values of specific resistance between the poles of the power supply and thus numerous unique values of heating rate for fluid of a given conductivity. Stated another way, the selective formation of shunt connections between electrodes allows the heater to provide a set of unique specific resistances which would otherwise require many more electrodes.

The heater discussed above with reference to FIGS. 1-11 further includes an optional control circuit 56 (FIG. 3). Although a particular control circuit is shown and discussed herein, it should be understood that the heater can be controlled by manually controlling the switches and the control circuit may be omitted. The particular control circuit of 56 includes a control processing unit 58 and one or more sensors for sensing the one or more operating parameters of the heater. In one example, the one or more sensors may include only an outlet temperature sensor 63 which is physically mounted in or near the outlet 24 of housing 12 to detect the temperature of fluid discharged from the heater. The temperature sensor may include conventional elements as, for example, one or more thermocouples, thermistors and resistance elements having electrical resistance which varies with temperature. The control processing unit 58 is linked to power switches 48 and shunting switches 50 as schematically indicated by broken line arrows in FIG. 3 so that the control processing unit can actuate the switches to provide various interconnection schemes as discussed. The control processing unit may include a memory 70 such as a non-volatile memory, random access memory or other conventional storage element. The memory desirably stores data for least some of the various connection schemes attainable by operation of the switches. The data in the table for each connection scheme may include the settings for each of the power switches 48 and for each of the shunting switches to form a particular connection scheme, as well as data specifying, either explicitly or implicitly, a ranking of the stored connection schemes order of their specific resistances. For example, the data for each connection scheme may include the specific resistance between the poles for that connection scheme, or equivalent data such as values of resistance or conductivity for the various connection schemes all measured or calculated for the case where the spaces are filled with a fluid of a given conductivity. Alternatively, the explicit data may be simply an ordinal number for each connection scheme. In an example of an implicit ranking, the data specifying switch settings for each connection scheme may be stored at addresses within the memory, such that the data at a lowest address specifies the switch settings for a connection scheme with the lowest specific resistance, the data at the next lowest address specifies the data for the connection scheme with the next lowest specific resistance, and so on.

Control processing unit 58 further includes a logic unit 72 connected to memory 70. The logic unit has one or more outputs connected to the power switches 48 and to shunting switches 50 as, for example, by conventional driver circuits (not shown) arranged to translate signals supplied by the logic unit to appropriate voltages or currents to actuate the switches. The logic unit may include a general-purpose processor programmed to perform the operations discussed herein, a hard-wired logic circuit, a programmable gate array, or any other logic element capable of performing the operations discussed herein. Although the term "unit" is used herein, this does not require that the elements constituting the unit be disposed in a single location. For example, parts of the control processing unit, or parts of the logic unit, may be disposed at physically separate locations, and may be operatively connected to one another through any communications medium.

In operation, the control unit may start the heater in operation by retrieving the switch setting data for the connection scheme with the highest specific resistance (lowest heating rate) and setting the switches accordingly, so that this connection scheme is set as the first connection scheme in use. After startup, the control unit periodically compares the outlet temperature of the fluid, as determined by outlet temperature sensor 63 with a setpoint temperature. If the outlet temperature is below the setpoint by more than a predetermined tolerance, the control unit retrieves the switch setting data for a connection scheme having specific resistance one step lower than the connection scheme then in use to provide a greater heating rate, and sets the switches accordingly. This process is repeated cyclically until the outlet temperature reaches the setpoint. If the outlet temperature exceeds the setpoint by more than the tolerance, the control unit selects a connection scheme with a specific resistance one step higher on the next cycle so as to reduce the heating rate. In this way, the control circuit will ultimately at a heating rate which brings the fluid to the desired output temperature. Desirably, the control system actuates the switches to change the control scheme at times when the alternating voltage applied to the hot pole 38 of the power supply is at or near zero. Such zero crossing times occur twice during each cycle of a conventional AC waveform. This arrangement minimizes switching transients and electrical noise generation.

In a more elaborate control system, the sensors linked to the control processing unit may include an inlet temperature sensor 61 which is positioned at the inlet 22 (FIG. 1); and outlet temperature sensor 62 positioned at the outlet 24 of the housing, and a flow rate sensor 76 which may be positioned anywhere in the flow path. The flow rate sensor may include conventional flow rate measurement devices such as ultrasonic or mechanical flow meters. The logic unit may compare the inlet temperature to the setpoint temperature to compute a desired temperature rise, and multiply the desired temperature rise by the flowrate and by a constant representing the specific heat of the fluid to arrive at a desired heating rate, and may select a connection scheme based at least in part on this desired heating rate as the first The sensors also may include a voltage sensor 78 connected to measure the electrical potential between poles 38 and 40 of the power supply and a current sensor 80 to measure the current passing through the power supply as a whole. Here again, conventional types of sensors for these purposes may be used. The logic unit may compute the actual resistance or conductance between the poles conductivity of the fluid based on the current and voltage, and may determine the conductivity of the fluid based on this resistance and the specific resistance of the connection scheme in use at the time of the current and voltage measurements. Alternatively, the sensors may include a separate, conventional instrument for measuring conductivity of the fluid. The control unit may compute a specific resistance between the poles needed to generate the desired heating rate with a fluid of the measured conductivity, and may select a connection scheme based on the computed specific resistance.

Where the sensors can measure conductivity of the fluid, the control system may use this information to exclude connection schemes which would violate physical limits on the system, such as a current rating of one or more switches. For example, the electrodes may include closely-spaced electrodes defining a very narrow space with low specific resistance. If these electrodes are connected to opposite poles of the power supply while the heater is filled with a high-conductivity fluid, the current passing through the power switches could exceed the current rating of the switches. However, such a connection can be used with a high-conductivity fluid. Use of a control system which can react to changes in conductivity in this way allows a given heater to include spaces with a greater range of specific resistances, and to accommodate a wider range of conductivity. This control technique can be used with or without the shunting arrangement discussed above.

Where the sensors can measure the voltage provided at the power supply, the control system can limit the selection of control schemes to limit the selection of connection schemes to only those usable with the detected voltage. Thus, the control system may exclude those connection schemes which will cause the current in one or more switches to exceed a maximum, to exclude those connection schemes which will cause the total current through the power supply to exceed a maximum limit. This approach is particularly useful where the control system can also measure conductivity. This approach facilitates operation of a heater having connection schemes spanning a broad range of specific resistances with different voltages. For example, the same heater may be operated on utility power at 110 or 220 volts, or with power from solar cells or an automobile electrical system, typically at 10-14 volts.

The specific resistance may be stated either as the specific resistance itself, or as other values which translate directly into the specific resistance. For example, the specific resistance between the poles for each connection scheme may be denoted by the conduction ratio, i.e., the ratio of conductance between the poles to conductivity of the fluid in the spaces between the electrodes. The conduction ratio is the inverse of the specific resistance. Also, the specific resistance for a given connection scheme may be represented by an "equivalent spacing", i.e., the distance between a pair of electrodes which, when used with no other electrodes, will provide the same resistance between the poles as provided by the connection scheme. The equivalent spacing is proportional to the specific resistance.

Figure 12:
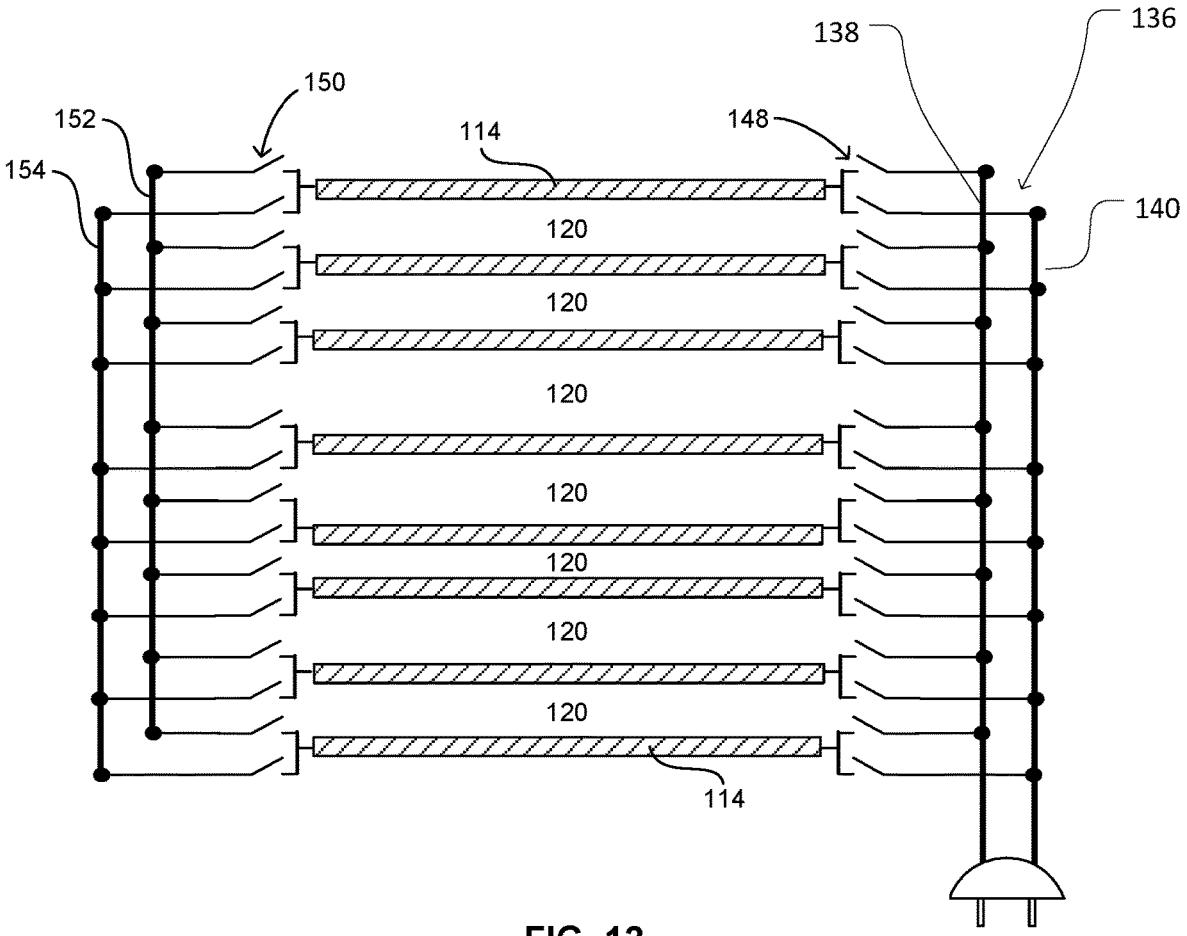
FIG. 12 is an electrical schematic of a heater according to a further embodiment of the invention.

A heater according to a further embodiment of the invention (FIG. 12) includes more electrodes than the heater discussed above with reference to FIGS. 1-11. The heater of FIG. 12 includes electrodes 114, spaces 120, a power supply 136 having poles 138 and 140, and power switches 148 associated with each electrode. These elements are similar to the corresponding elements in the embodiment discussed above. In this embodiment, two shunting busses 152 and 154 are provided, rather than the single shunting bus used in the embodiment discussed above. Also, the shunting switches 150 can connect each electrode to either shunting bus. This arrangement allows formation of two independent shunt connections, so that any two or more of the electrodes can be connected to one another using the first shunting bus, whereas any two or more of the electrodes can be connected to one another using the second shunting bus. This embodiment can thus form two shunt connections which are electrically isolated from one another. This arrangement can provide even more connection schemes with different specific resistances. The heater can include any number of electrodes, and any number of shunting buses.

Other arrangements can be used to establish one or more shunts between electrodes. For example, a cross-point network may have conductors connected to the electrodes, these conductors including some extending in a row direction and others extending in a column direction transverse to the row direction, so that conductors connected to different electrodes cross one another but are normally electrically isolated from one another. The shunting switches may be provided at the crossings so that shunt connections can be made by connecting the crossing conductors to one another. In a further variant, some of the electrodes may be provided with one or more dedicated shunting switches, each such shunting switch being connected to a different one of the other electrodes. Thus, a shunting connection can be established between two electrodes by closing one of the shunting switches.

In the embodiments discussed above with reference to FIGS. 1-12, every electrode is provided with shunting switches and with power switches, so that every electrode can be connected to either pole of the power supply, or to another electrode via a shunt connection, or can be left entirely unconnected. However, some of the switches may be omitted, so that one or more individual electrodes can be connected to a power supply but not to a shunt, so that one or more of the electrodes may be connected only to a shunt, or both.

A heater according to a further embodiment of the invention (FIGS. 13 and 14) is similar to the heater discussed above with reference to FIGS. 1-11. However, in the heater of FIGS. 13 and 14, the structure 212 defines an inlet manifold 221 connected to the fluid inlet 222 and an outlet manifold 223 connected to the fluid outlet 224. Each of the spaces 220 between electrodes 214 extends from the inlet manifold 221 to the outlet manifold 223, so that fluid entering the heater will be divided into separate streams which flow the various spaces in a parallel flow arrangement. Other, more complex flow arrangements can be used.

Figure 13:
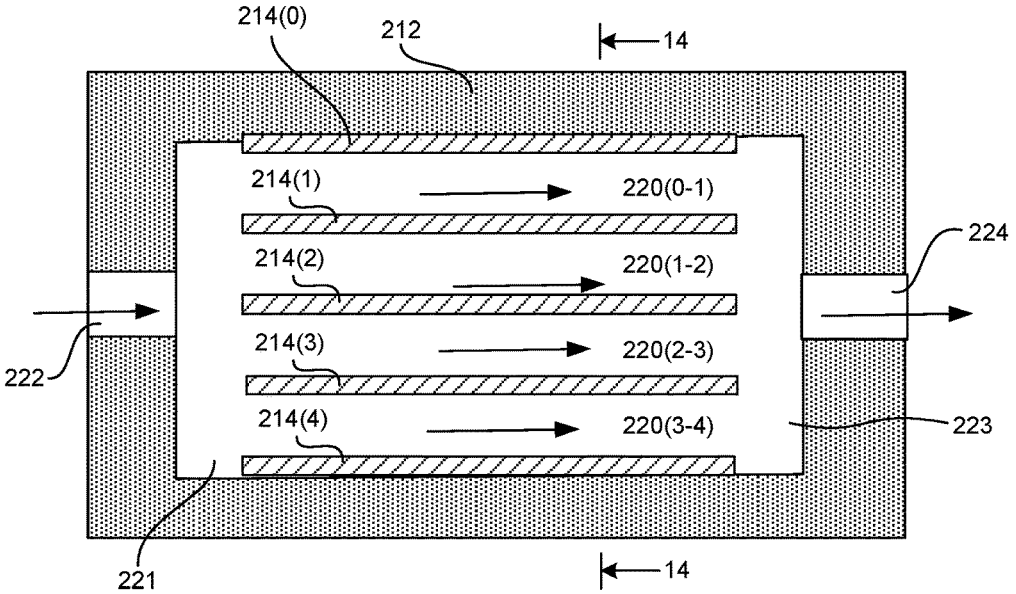
FIG. 13 is a diagrammatic sectional view of a heater according to a still further embodiment of the invention.
Figure 14:
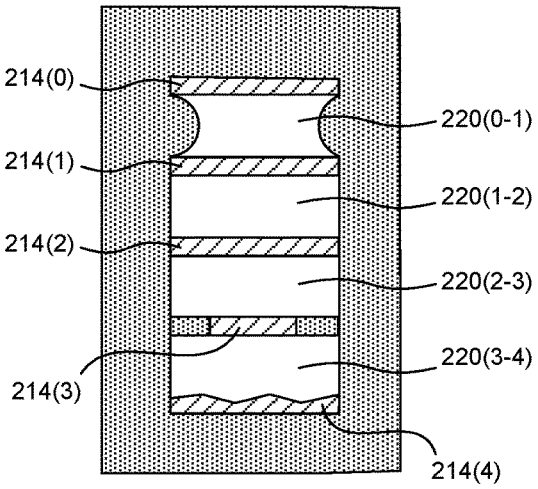
FIG. 14 is a diagrammatic sectional view taken along line 14-14 in FIG. 13.

In the heater of FIGS. 13 and 14, the electrodes are disposed at uniform spacing. However, the specific resistance through the fluid in different ones of the spaces 220 is different due to other factors. For example, the specific resistance of space 220(0-1) is higher than the specific resistance of space 220(1-2) because space 220 (0-1) is constricted. The specific resistance of space 220(2-3) is reduced by the relatively small exposed area of electrode 214(3). The jagged surface configuration of electrode 214(4) modifies the specific resistance of space 222(3-4).

In a further variant, the each of the spaces may have the same specific resistance, but the heater may be provided with the shunting arrangement discussed above. The shunting arrangement discussed above will still be advantageous in this situation.

Figure 15:
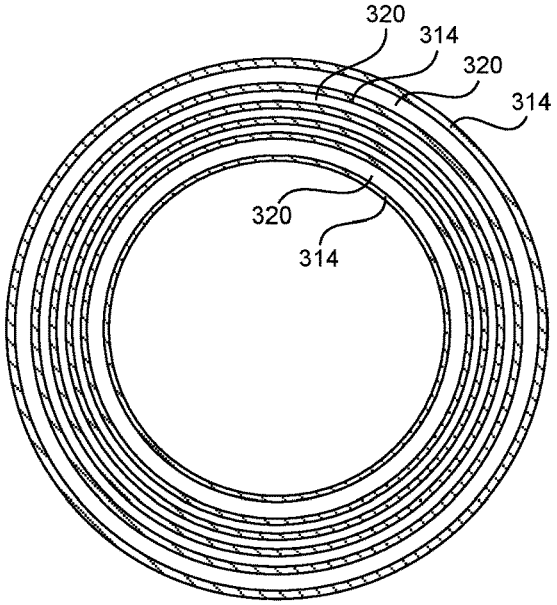
FIG. 15 is a diagrammatic sectional view depicting elements of a heater in accordance with yet another embodiment of the invention.

The electrodes need not be plate-like. For example, the heater of FIG. 15 includes tubular electrodes 314 separated by annular spaces 320.

Figure 16:
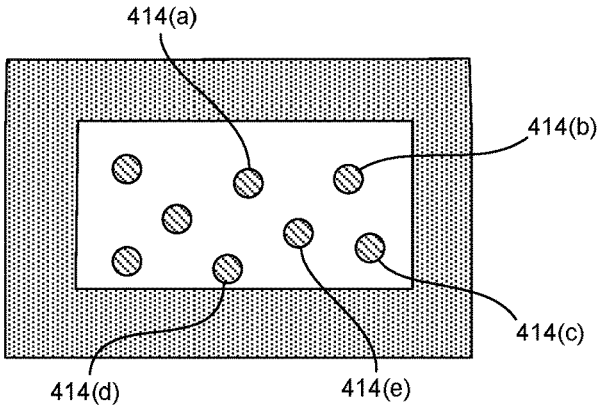
FIG. 16 is a diagrammatic sectional view depicting a heater according to yet another embodiment of the invention.

The shunting arrangement and other features discussed herein also can be applied to electrodes disposed in a multidimensional array. For example, a heater as shown in FIG. 16 incorporates numerous rod-like electrodes extending in the direction perpendicular to the plane of the drawing. These electrodes are disposed in an irregular two-dimensional array. In this arrangement, one or more electrodes may have multiple neighboring electrodes. For example, electrodes 414(*a*),414(*b*), 414(*c*) and 414(*d*) are all neighbors of 414(*e*). The current paths in such a two-dimensional array a more complex, but the same principle applies: selective formation of shunt connections increases the number of different connection schemes and different specific resistances between the poles of the power supply which can be achieved.

It is not essential that the structure holding the electrodes defines a housing, or that fluid flow through the heater during operation. For example, the features described above can be applied to where the electrodes are exposed on the outside of the structure, so that the spaces between electrodes can be filled with the fluid to be heated by immersing the structure in the fluid.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A heater for heating an electrically conductive fluid comprising:

(a) a structure;

(b) a plurality of electrodes mounted to the structure with spaces between neighboring ones of the electrodes, the structure being adapted to maintain the electrodes in contact with the fluid with fluid in the spaces, so that fluid in the spaces contacts the electrodes and electrically connects neighboring electrodes to one another;

(c) an electrical power supply having at least two poles, the power supply connection being operable to supply different electrical potentials to different ones of the poles;

(d) power switches electrically connected between at least some of the electrodes and the poles, the power switches being operable to selectively connect the electrodes to the poles and to selectively disconnect electrodes from the poles, the power switches being operable to connect and disconnect electrodes so that the electrodes include at least first and second connected electrodes connected to different poles of the power supply and first and second isolated electrodes disconnected from the poles; and (e) shunting switches electrically connected to at least some of the electrodes, the shunting switches being operable to selectively form a shunt connection between the first and second isolated electrodes.

2. A fluid heater as claimed in claim 1 wherein the power switches and shunting switches are operable to connect the electrodes in a plurality of connection schemes so that different ones of the electrodes constitute the connected electrodes and the isolated electrodes in different ones of the connection schemes.

3. A fluid heater as claimed in claim 2 wherein in at least one of the connection schemes, a conduction path extends from the first connected electrode through fluid in at least one of the spaces to the first isolated electrode, through the shunt connection to the second isolated electrode, and from the second isolated electrode through fluid in at least another one of spaces to the second connected electrode.

4. A fluid heater as claimed in claim 2 further comprising one or more sensors operative to detect one or more operating conditions of the heater, and a controller connected to the one or more sensors, the power switches and the shunting switches, the controller being operative to control the power and shunting switches to select different conduction schemes responsive to one or more of the operating conditions.

5. A fluid heater as claimed in any one of claims 1-4 wherein a distance between at least one pair of neighboring ones of the electrodes is different from a distance between at least one other pair of neighboring ones of the electrodes.

6. A fluid heater as claimed in claim 5 wherein at least some of the electrodes are plates having major surfaces, the plates being arranged in a stack with the major surfaces of neighboring ones of the plates confronting one another and bounding the spaces between the plates.

7. A fluid heater as claimed in any one of claims 1-4 wherein a specific resistance of at least one of the spaces is different from a specific resistance of at least another one of the spaces.

8. A fluid heater as claimed claim 1 wherein the power supply switches are operable to connect and disconnect electrodes with the power supply so that there are at least four isolated electrodes including the first and second isolated electrodes and third and fourth isolated electrodes, and wherein the shunting switches are operable to form at least two separate shunt connections so as to connect the first and second isolated electrodes to one another and connect the third and fourth isolated electrodes to one another without connecting the third and fourth isolated electrodes to the first and second isolated electrodes.

9. A fluid heater as claimed in claim 7 further comprising first and second shunting busses, at least some of the shunting switches being connected between at least some of the electrodes and the first shunting bus and at least some of the shunting switches being connected between at least some of the electrodes and the second shunting bus.

10. A fluid heater as claimed in claim 1 further comprising a first electrically conductive shunting bus, at least some of the shunting switches being connected between at least some of the electrodes and the first shunting bus.

11. A fluid heater as claimed in claim 1 wherein at least some of the electrodes are multipurpose electrodes, each of the multipurpose electrodes being electrically connected to one or more of the power switches and to one or more of the shunting switches.

12. A fluid heater as claimed in claim 1 wherein the structure includes an enclosure and the electrodes and spaces are disposed within the enclosure.

13. A fluid heater as claimed in claim 12 wherein the enclosure has an inlet and an outlet and the electrodes and enclosure are arranged so that the fluid can flow from the inlet to the outlet through the spaces.

14. A method of heating an electrically conductive fluid comprising:

(a) contacting the fluid with a plurality of electrodes having spaces between neighboring ones of the electrodes so that the fluid in the spaces contacts the electrodes and electrically connects neighboring electrodes to one another;

(b) selectively connecting and disconnecting the electrodes and poles of a power supply so that different electrical potentials are applied to at least some of the electrodes and current flows between at least some of the electrodes through the fluid, the step of selectively connecting and disconnecting the electrode with the poles being performed so that the electrodes include at least first and second connected electrodes connected to different poles of the power supply and first and second isolated electrodes disconnected from the poles; and (c) electrically connecting the first and second isolated electrodes to one another without connecting the first and second isolated electrodes to the poles of the power supply.

15. A method as claimed in claim 14 wherein steps (b) and (c) are performed so as to vary the selection of electrodes constituting the first and second connected electrodes and the first and second isolated electrodes so as to form different connection schemes.

16. A method as claimed in claim 15 wherein a specific resistance between the poles of the power supply is different for different ones of the connection schemes.

17. A method as claimed in claim 16 further comprising the step of detecting one or more operating conditions and selecting a connection scheme responsive to one or more of the detected operating condition.

18. A method as claimed in any one of claims 14-16 wherein step (a) includes passing the fluid through an enclosure containing the electrodes so that the fluid flows through the spaces during steps (b) and (c).

* * * * *